US006857243B2

(12) United States Patent
Bloomfield

(10) Patent No.: US 6,857,243 B2
(45) Date of Patent: Feb. 22, 2005

(54) WALLBOARD EDGE AND METHOD FOR USE

(76) Inventor: Paul F. Bloomfield, 307 Spring Ave., Ardmore, PA (US) 19003

( * ) Notice: Subject to any disclaimer, the term of this patent is extended or adjusted under 35 U.S.C. 154(b) by 0 days.

(21) Appl. No.: 10/392,217

(22) Filed: Mar. 19, 2003

(65) Prior Publication Data

US 2003/0177730 A1 Sep. 25, 2003

Related U.S. Application Data

(60) Provisional application No. 60/365,505, filed on Mar. 19, 2002.

(51) Int. Cl.[7] ..... E04B 2/08

(52) U.S. Cl. ..... 52/591.4; 156/304.5; 156/304.3; 156/92

(58) Field of Search ..... 52/460, 462, 483.1, 52/592.1, 591.4, 748.11, 591.1; 156/304.5, 304.3, 91, 92, 71

(56) References Cited

U.S. PATENT DOCUMENTS 1,646,809 A * 10/1927 Brandt ..... 52/509
2,115,936 A * 5/1938 Sterns ..... 52/601
2,276,071 A * 3/1942 Scull ..... 52/591.4
2,412,693 A * 12/1946 Pierson ..... 156/157
3,535,844 A 10/1970 Glaros
3,576,091 A * 4/1971 Shull et al. ..... 52/309.3
3,816,199 A * 6/1974 Dawdy et al. ..... 156/71
4,095,913 A 6/1978 Pettersson et al.
4,104,840 A 8/1978 Heintz et al.
4,187,653 A 2/1980 Kliewer, Jr.
4,575,981 A 3/1986 Porter
4,656,805 A * 4/1987 Winkowski ..... 52/417
5,390,458 A 2/1995 Menchetti
5,427,643 A * 6/1995 Aitken et al. ..... 156/304.5
6,023,900 A * 2/2000 Stoehr et al. ..... 52/403.1
6,226,946 B1 * 5/2001 Stough et al. ..... 52/417
6,247,285 B1 6/2001 Moebus

* cited by examiner

*Primary Examiner*—Peter M. Cuomo
*Assistant Examiner*—Stephen Vu
(74) *Attorney, Agent, or Firm*—Akin Gump Strauss Hauer & Feld, LLP

(57) ABSTRACT

A wallboard, wallboard joint and method for joining adjacent wallboards. A first wallboard has first and second edges extending between a face and back of a core. The second edge is an inverted mirror image of the first edge. A facing-material covers the face and has a first end extendable beyond the face. The first end has an adhesive surface covered by a removable strip. The wallboard joint and method for joining adjacent wallboards provides for overlapping and mating the first edge of the first wallboard with a second edge of a substantially similar second wallboard, securing the first and second wallboards to a structural member by passing a fastener through the first and second edges and into the structural member, and adhering the adhesive surface of the face of the first wallboard to the second wallboard.

10 Claims, 6 Drawing Sheets

WALLBOARD EDGE AND METHOD FOR USE

CROSS-REFERENCE TO RELATED APPLICATIONS

This application claims benefit of U.S. Provisional Patent Application No. 60/365,505, "Wallboard Edge Detail", filed Mar. 19, 2002, the subject matter of which is incorporated herein by reference.

BACKGROUND OF THE INVENTION

The present invention relates generally to wallboard. More particularly, the present invention relates to wallboard having an edge detail that provides for the coupling of adjacent edges of two wallboards as further described herein.

Conventional wallboard edge joints are typically formed by securing, with screws or nails two tapered edges of adjacent wallboard panels to the same structural member, such as a stud or joist. After the panels are secured to the structural member, a layer of joint compound is applied to the joint. Tape, either paper or fiberglass, is typically set into the layer of joint compound. Successive layers of joint compound are applied with progressively wider tools, allowed to dry and sanded. To obtain the desired surface, this process typically requires three or more applications of joint compound and takes days to complete.

Wallboard having edge detail that provides for the coupling of adjacent edges of two wallboards is highly desirable. More specifically, wallboard having edge detail, such as zigzag or dovetail edges that fit into or couple with each other, provide numerous benefits including, but not limited to, the following: (i) self-alignment of adjacent wall board panels; (ii) allowing adjacent wallboard panels to be secured to a structural member by fasteners that pass through the edge of each panel and are positioned on the center line of and driven into the structural member; and (iii) reduction in finishing time.

BRIEF SUMMARY OF THE INVENTION

Briefly stated, one aspect of the present invention is directed to a wallboard. The wallboard comprises a core having a face and a back substantially parallel to the face. A first edge extends between the face and the back. The first edge has a first-edge profile formed by first, second and third facets. The first facet is adjacent the face and forms an acute angle with respect to the face. The second facet connects the first and third facets and has a second-facet profile angled with respect to the face. The second-facet profile is configured to distribute over more than one-half a cross-section of the core a force applied to the first edge. The third facet is adjacent the back and forms an obtuse angle with respect to the back. A second edge is spaced from the first edge and extends between the face and the back. The second edge has a second-edge profile corresponding to the first-edge profile.

Another aspect of the invention is a wallboard comprising a core having a face and a back substantially parallel to the face. A first edge extends between the face and the back. The first edge has a first-edge profile formed by first, second and third facets. The first facet is adjacent the face and forms an acute angle with respect to the face. The second facet connects the first and third facets and has a second-facet profile angled with respect to the face. The second-facet profile is configured to distribute over more than one-half a cross-section of the core a force applied to the first edge. The third facet is adjacent the back and forms an obtuse angle with respect to the back. A second edge is spaced from the first edge and extends between the face and the back. The second edge has a second-edge profile corresponding to the first-edge profile. A facing-material covers the face. The facing-material has a first end and a second end. The first end extends beyond the face and has an adhesive surface. The second end is spaced from the second edge.

Another aspect of the of the present invention is directed to a joint providing for coupling a first wallboard having a first-wallboard face with a second wallboard having a second-wallboard face. The joint comprises a first edge of the first wallboard and a second edge of the second wallboard adjacent the first edge. The first edge has a first-edge profile and the second edge has a second-edge profile. The second edge is configured to mate with the first edge. The first and second edge profiles are configured to align the first-wallboard face with the second-wallboard face and maintain alignment.

Still another aspect of the present invention is directed to a method for joining adjacent wallboards and securing the wallboards to a structural member. The method comprises the steps of providing a first wallboard having a first-wallboard edge with a first-wallboard edge profile and a second wallboard having a second-wallboard edge with the second-wallboard edge profile corresponding to the first-wallboard edge profile; mating the first-wallboard edge with the second-wallboard edge; securing the first and second wallboards to a structural member by passing a fastener through the first-wallboard edge and the second-wallboard edge and into the structural member; and attaching to the second-wallboard a first end of a facing material covering the first-wallboard face.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment that is presently preferred, a gypsum based wallboard with a paper facing and a paper backing layer. It should be understood, however, that the invention is not limited to the precise arrangements and instrumentalities shown. In the drawings.

DETAILED DESCRIPTION OF THE INVENTION

Figure 1:
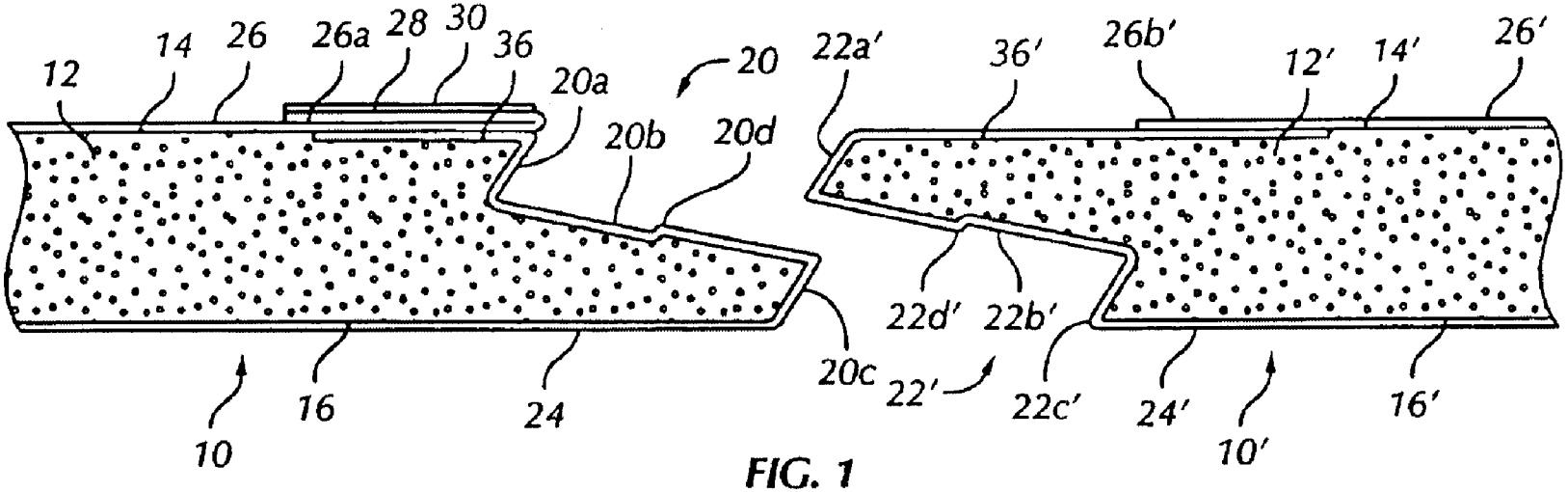
FIG. 1 is a top plan view of a portion of a first wallboard showing a first edge of the first wallboard proximal to a second edge of a second wallboard, in accordance with an embodiment of the present invention.

Certain terminology is used in the following description for convenience only and is not limiting. The words "right", "left", "top", and "bottom" designate directions in the drawings to which reference is made. The words "inwardly" and "outwardly" refer to directions toward and away from, respectively, the geometric center of the archery target and designated parts thereof. The terminology includes the words above specifically mentioned, derivatives thereof and words of similar import.

Referring to FIG. 1, there is shown a portion of a wallboard, generally designated 10, and hereinafter referred to as the "first wallboard" 10, and a portion of another wallboard, generally designated 10', and hereinafter referred to as the "second wallboard" 10' in accordance with the preferred embodiment of the present invention. The first and second wallboards 10, 10' are substantially the same. Accordingly, prime numbers will be used to refer to features in the second wallboard 10' that correspond to equivalent features in the first wallboard 10.

The first wallboard 10 comprises a core 12 having a face 14 and a back 16 substantially parallel to the face 14. Typically, the first wallboard 10 is made from gypsum, but can be any well known material used in the fabrication of wallboard or wall paneling such as wood, metal, or polymeric materials and the like. The second wallboard 10' also comprises a core 12' having a face 14' and a back 16' substantially parallel to the face 14'.

The first wallboard 10 has a first edge 20 and a second edge (not shown). The second wallboard 10' has a first edge (not shown) and a second edge 22'. The second edge of the first wallboard 10 is substantially the same as the second edge 22' of the second wallboard 10'. Similarly, the first edge of the second wallboard 10' is substantially the same as the first edge 20 of the first wallboard 10. Accordingly, for brevity, only the features of the first edge 20 of the first wallboard 10 and the features of the second edge 22' of the second wallboard 10' are discussed below.

Figure 2:
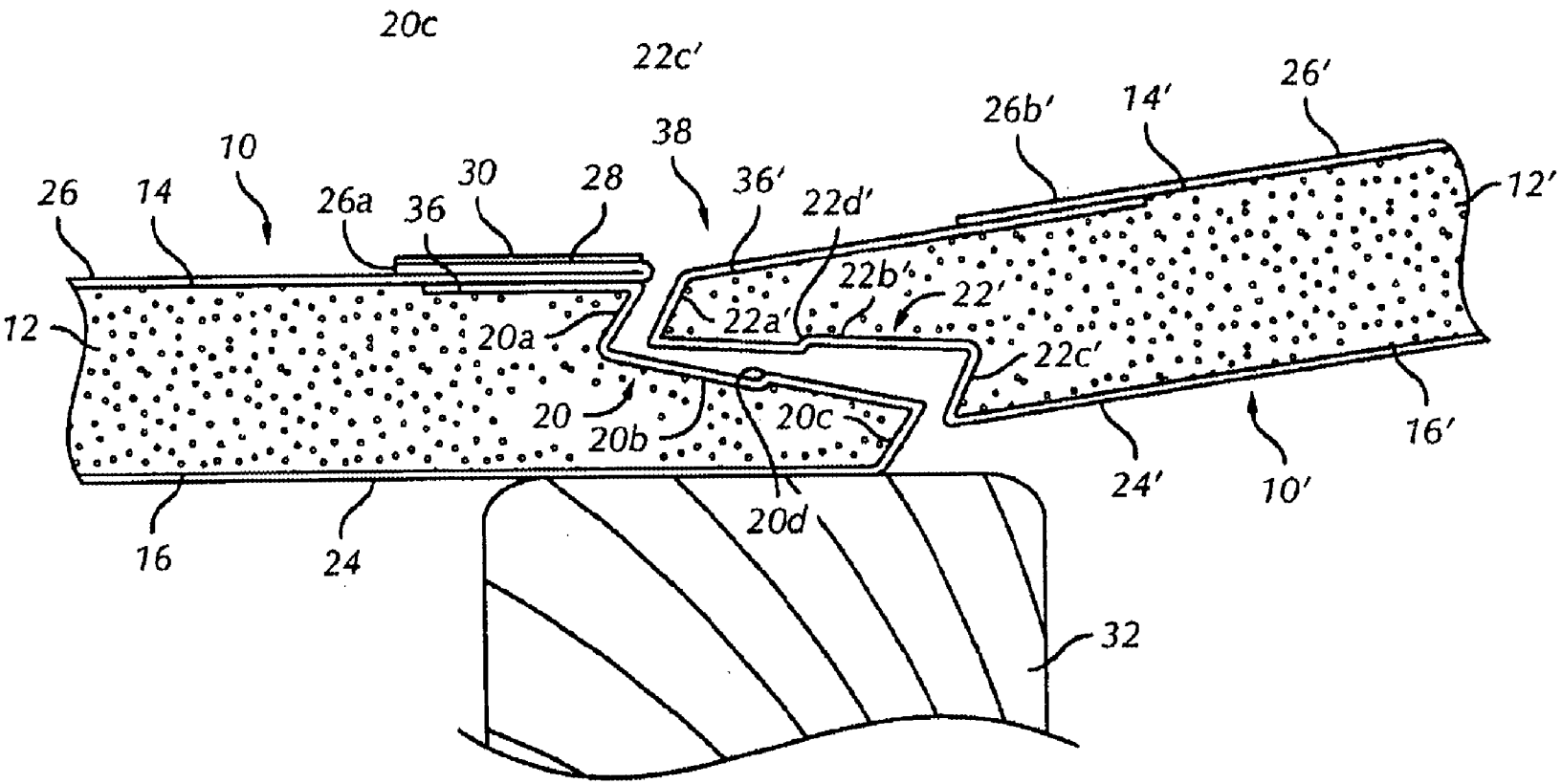
FIG. 2 is a top plan view of the first edge of the first wallboard being mated with the second edge of the second wallboard of FIG. 1.
Figure 3:
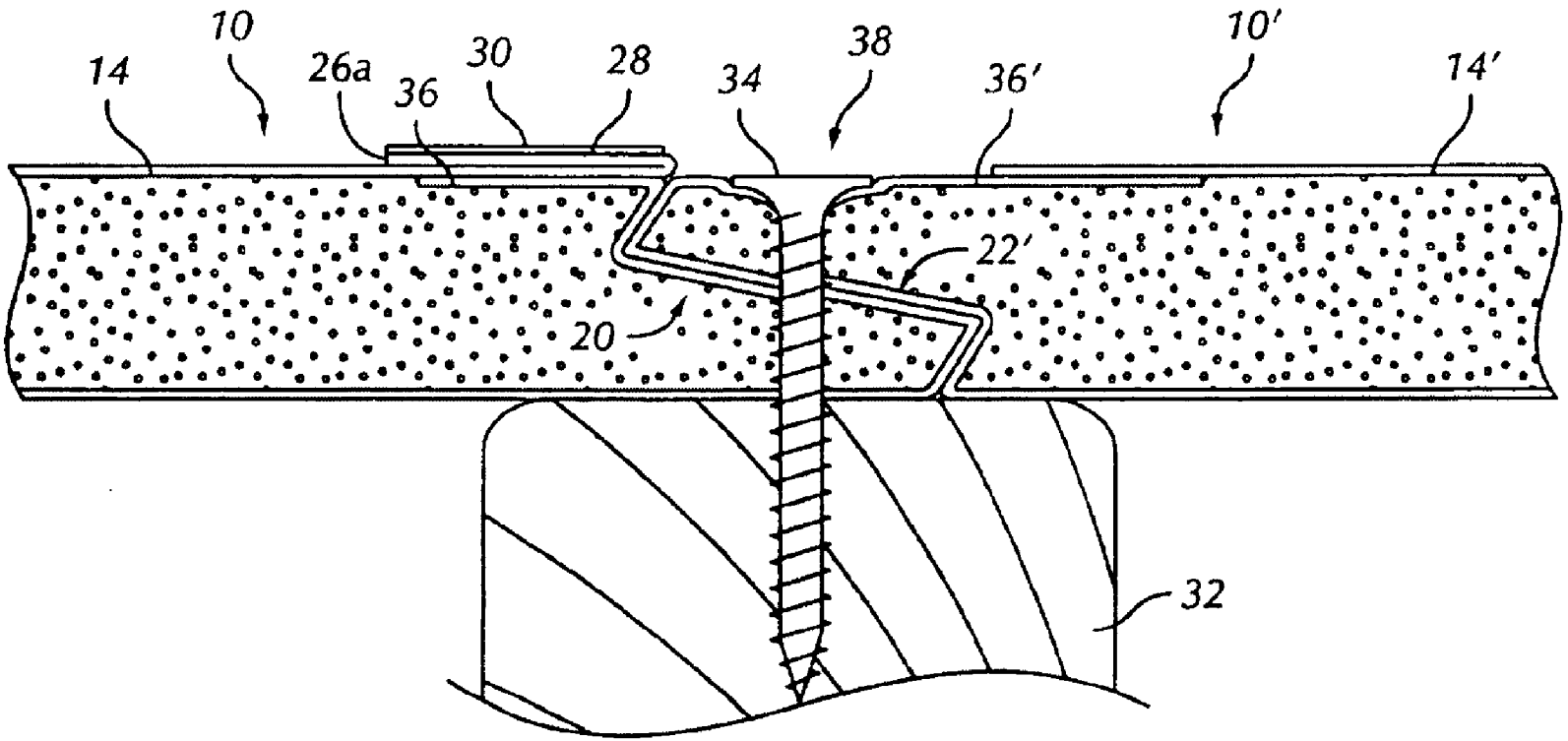
FIG. 3 is a top plan view of the first edge of the first wallboard mated with the second edge of the second wallboard of FIG. 1 forming a joint fastened to a structural member.

The first edge 20 of the first wallboard 10 and the second edge 22' of the second wallboard 10' have edge profiles that are configured to fit together to form a joint that aligns the first and second wallboards 10, 10' and allows a single fastener to secure two adjoining wallboards to a structural member as shown in FIGS. 2–3 and as further discussed below.

The first edge 20 of the first wallboard 10 extends between the face 14 and the back 16 of the first wallboard 10. The first edge 20 has a first-edge profile formed by first, second and third facets 20*a*, 20*b*, 20*c* respectively. The first facet 20*a* is adjacent the face 14 and forms an acute angle with respect to the face 14. The second facet 20*b* connects the first and third facets 20*a*, 20*c* and has a second-facet profile angled with respect to the face 14. The second-facet profile is angled with respect to the first and third facets 20*a*, 20*c*. The second-facet profile is configured to distribute over more than one-half a cross-section of the core 12 a force applied to the first edge 20. The third facet 20*c* is adjacent the back 16 and forms an obtuse angle with respect to the back 16. Preferably, but not necessarily, the first edge 20 has a shoulder 20*d* located on the second facet 20*b* generally equidistant from the first and third facets 20*a*, 20*c*.

The second edge of the first wallboard 10 is spaced from the first edge 20 and extends between the face 14 and the back 16 of the first wallboard 10. The second edge of the first wallboard 10 has a second-edge profile corresponding to the first-edge profile. Preferably the second edge of the first wallboard 10 is an inverted mirror image of the first edge 20 and as earlier stated is substantially the same as the second edge 22' of the second wallboard 10'.

The second edge 22' of the second wallboard 10' is formed by first, second, and third facets 22*a'*, 22*b'*, 22*c'*, respectively corresponding to the facets 20*a*, 20*b*, 20*c* forming the first edge 20 of the first wallboard 10. The first facet 22*a'* is adjacent to and forms an obtuse angle with respect to the face 14'. The second facet 22*b'* connects the first and third facets 22*a'*, 22*c'* and has a second-facet profile angled with respect to the face 14' and with respect to the first and third facets 22*a'*, 22*c'*. The second-facet profile is configured to distribute over more than one-half the cross-section of the core 12' a force applied to the second edge 22'. The third facet 22*c'* is adjacent to and forms an acute angle with respect to the back 16'. Preferably, but not necessarily the second edge 22' has a shoulder 22*d'* located on the second facet 22*b'* generally equidistant from the first and third facets 22*a'*, 22*c'*.

Those skilled in the art will understand from this disclosure that the facets 20*a*, 20*b*, 20*c* of the first edge 20 of the first wallboard 10 and the facets 22*a'*, 22*b'*, 22*c'* of the second edge 22' of the second wallboard 10' preferably have corresponding profiles configured to allow adjacent wallboards having first and second edges in accordance with the present invention to form a self-aligned joint when the first and second edges are mated. Further, the artisan will also understand that the shoulder 20*d* of the first edge 20 and the shoulder 22*d'* of the second edge 22' preferably have corresponding profiles providing for the formation of a key that produces a snap-together-like fit when wallboards having edges in accordance with the present invention are mated, thereby maintaining the alignment of the wallboards.

The first wallboard 10 and the second wallboard 10' have a facing-material 26, 26'. The facing-material 26, 26', typically paper having a thickness of less than one-sixteenth inch, also can be any well known backing or facing material used in wallboard fabrication such as fabric or polymeric films and can have varying thickness.

Those skilled in the art will understand that the wallboards 10, 10' may have a backing-material 24, 24' that covers the back 16, 16' and the first and second edges 20, 22' of the respective wallboards 10, 10'. The backing-material 24, 24' may extend over a portion of the face 14, 14' adjacent the first and second edges 20, 22' of the first and second wallboards 10, 10', respectively. Preferably, the face 14, 14' of the core 12, 12' underlying the backing-material 24, 24' has a recess 36, 36' with a depth generally corresponding to the thickness of the backing-material 24, 24'. Alternatively, as discussed below, absent a backing material, the wallboards 10, 10' may have only one recess adjacent the second end.

The facing-material 26, 26' covers the face 14, 14' of the respective wallboards 10, 10'. The facing-material 26 for the first wallboard 10 has a first end 26*a* and a second end (not shown). The facing-material 26' for the second wallboard 10' has a first end (not shown) and a second end 26*b'*. The facing-material 26 for the first wallboard 10 is substantially the same as the facing material 26' for the second wallboard 10'. Accordingly, for brevity, only the features of the first end 26*a* of the first wallboard 10 and the features of the second end 26*b'* of the second wallboard 10' will be discussed below.

A portion of the first end 26*a* of the facing-material 26 for the first wallboard 10 is extendable beyond the face 14 and has an adhesive surface 28 preferably covered by a removable strip 30. As shown in FIG. 1, the portion of the first end 26*a* of the facing-material 26 that is extendable beyond the face 14 is folded back on itself and the adhesive surface 28 and the removable strip 30 are outwardly facing.

Preferably, the second end 26*b*' of the facing-material 26' for the second wallboard 10' is spaced from the second edge 22' to provide a recess that accommodates the extended corresponding first end of the facing material 26 of the adjacent first wallboard 10.

Figure 4:
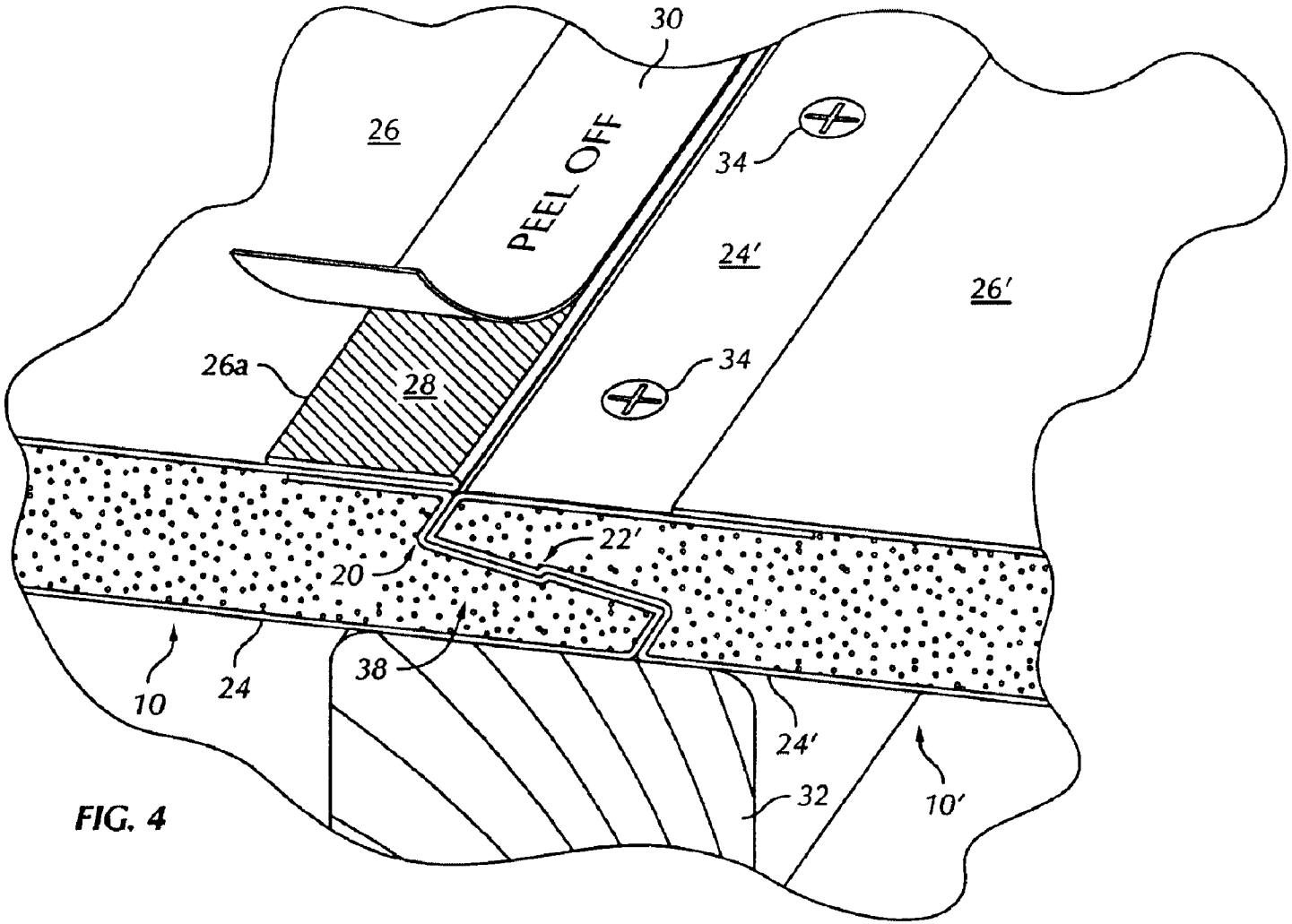
FIG. 4 is a top perspective view of a portion of the joint of FIG. 3, showing a facing-material extension prior to the extension being rotated into adhesive engagement with a the face of the second wallboard.
Figure 5:
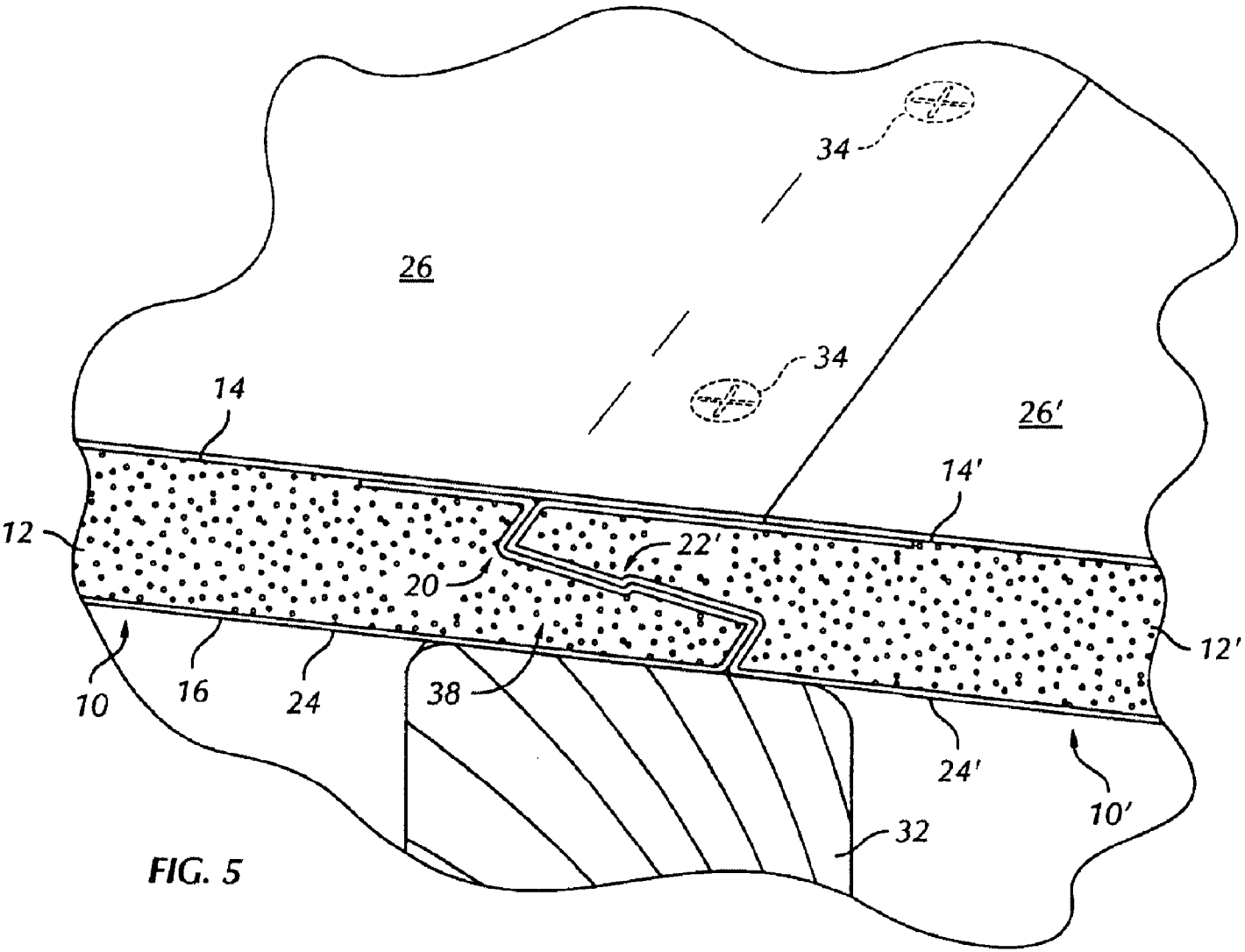
FIG. 5 is a top perspective view of the portion of the joint of FIG. 3, showing the facing material extension adhesively attached to the second wallboard.

Referring to FIGS. 3–5, there is shown a joint, generally designated 38, and hereinafter referred to as the "joint" 38, in accordance with the present invention. The joint 38 is for coupling a first-wallboard 10 having a first-wallboard face 14 with a second wallboard 10' having a second-wallboard face 14'. The joint 38 allows for securing with a fastener 34 the first and second wallboards 10, 10' to a structural member 32. In the preferred embodiment illustrated, the fastener 34 is shown to be a conventional screw fastener. The artisan would recognize that other fasteners such as nails or staples could also be used. The joint 38 comprises a first edge 20 of the first wallboard 10 and a second edge 22' of the second wallboard 10' adjacent the first edge 20.

The first edge 20 has a first-edge profile that is preferably formed by first, second and third facets 20*a*, 20*b*, 20*c*. The first facet 20*a* is adjacent the first-wallboard face 14 and forms an acute angle with respect to the first-wallboard face 14. The second facet 20*b* connects the first and third facets 20*a*, 20*c* and has a second-facet profile angled with respect to the face 14. The second-facet profile is angled with respect to the first and third facets 20*a*, 20*c*. The second-facet profile is configured to distribute over more than one-half a cross-section of the core 12 a force applied to the first edge 20. The third facet 20*c* is adjacent the back 16 and forms an obtuse angle with respect to the back 16. The first edge 20 preferably has a shoulder 20*d* located on the second facet 20*b*.

The second edge 22' has a second-edge profile and is configured to mate with the first edge 20. The first and second edge profiles are configured to align the first-wallboard face with the second-wallboard face and maintain alignment. The first and second edge profiles are configured to distribute over more than one-half a cross-section of the first and second wallboards 10, 10' a force applied to the first and second edges 20, 22'. Preferably, the joint 38. is further configured to allow the first and second wallboards 10, 10' to be secured to the structural member 32 by the passing of the fastener 34 through the first and second edges 20, 22' and into the structural member 32. Preferably, but not necessarily, the second edge 22' is configured as an inverted mirror image of the first edge 20 and the first and second edges 20, 22' are compressively mateable.

A facing-material 26 is attached to the first-wallboard face 14. The facing-material 26 has a first end 26*a* that is extendable beyond the first-wallboard face 14. The first end 26*a* has an adhesive surface 28 preferably covered by a removable strip 30. The adhesive surface 28 is adhereable to the second-wallboard 10' upon removal of the removable strip 30. Preferably, the second-wallboard face 14' has a second-wallboard recess 36' adjacent the second edge 22' as the second end 26*b*' of the facing-material 26 is spaced from the second edge 22' to accommodate the extended length of the first end 26*a* of the facing-material 26 of the adjacent first wallboard 10.

Figure 6:
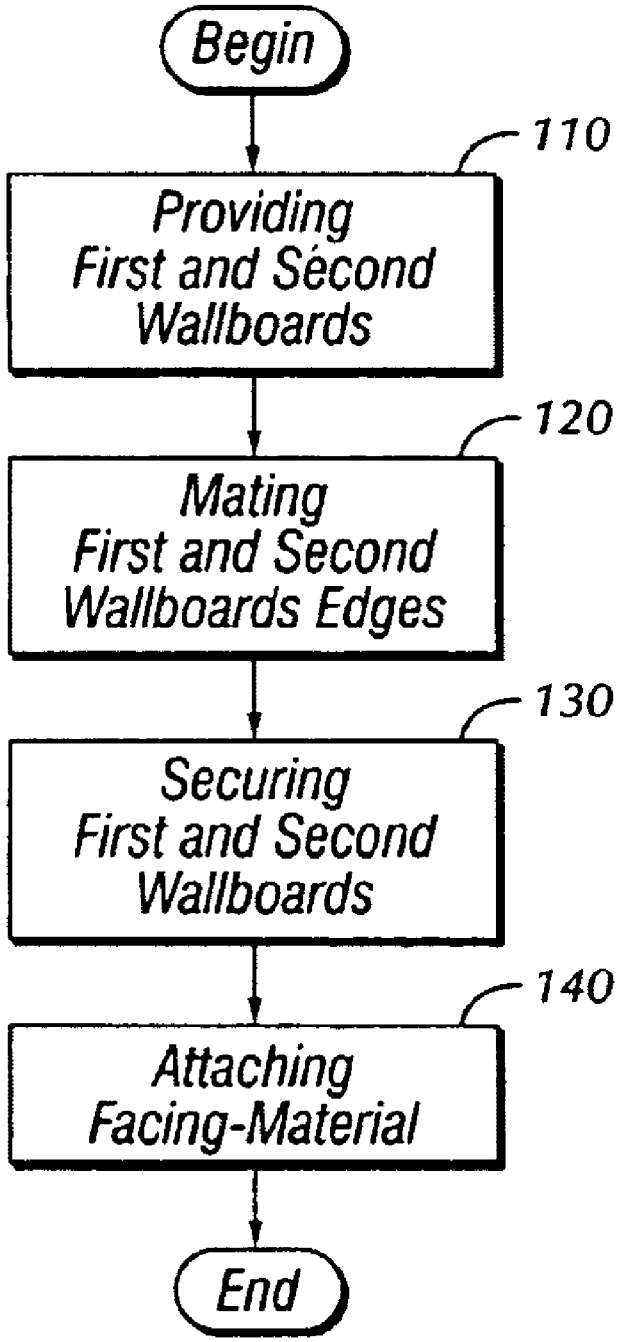
FIG. 6 is a diagram of the steps of a method for joining adjacent wallboards in accordance with the present invention.

Referring to FIG. 6, the above disclosed wallboard 10, 10' and the joint 38 of the present invention are preferably used in accordance with a method generally designated 100, and hereinafter referred to as the "joining method" 100. The joining method 100 provides for the joining of adjacent wallboards, the securing of the joined wallboards to a structural member, and the finishing of the joint as desired by the user as disclosed below. The joining method 100 comprises four steps as shown in FIG. 6.

At step 110, the user provides a first wallboard 10 having a core 12, a face 14, a back 16, a first-wallboard edge 20 with a first-wallboard edge profile and a second wallboard 10' having a core 12', a face 14', a back 16', and a second-wallboard edge 22' with a second-wallboard edge profile. Preferably, the first and second wallboard edges 20, 22' are configured to compressively fit together to align the faces 14, 14' of the wallboards 10, 10' during the mating step discussed below. Preferably, but not necessarily, the second-wallboard edge profile is an inverted mirror image of the first-wallboard edge profile. Preferably the first-wallboard edge profile is formed by first, second and third facets 20*a*, 20*b*, 20*c*, respectively. The first facet 20*a* is adjacent the face 14 and forms an acute angle with respect to the face 14. The second facet 20*b* connects the first and third facets 20*a*, 20*c* and has a second-facet profile angled with respect to the first and third facets 20*a*, 20*c*. The third facet 20*c* is adjacent the back 16 and forms an obtuse angle with respect to the back 16.

Preferably, the first edge 20 of the first wallboard 10 has a first-wallboard edge shoulder 20*d* located on the second facet 20*b* of the first-wallboard edge 20. Similarly, the second edge 22' of the second wallboard 10' has a corresponding second-wallboard edge shoulder 22*d*' located on the second facet 22*b*' of the second-wallboard edge 22'.

At step 120, the user mates the first-wallboard edge 20 with the second-wallboard edge 22'. Preferably, the mating step 120 includes interlocking the first-wallboard edge shoulder 20*d* extending from the first-wallboard edge 20 with the corresponding second-wallboard edge shoulder 22*d*' extending from the second-wallboard edge 22'. Those skilled in the art will understand that the interlocking is provided by the introduction of a compressive force between the first-wallboard edge shoulder 20*d* and the corresponding second-wallboard edge shoulder 22*d*'.

At step 130, if required, the user secures the first and second wallboards 10, 10' to the structural member 32 by passing the fastener 34 through the first-wallboard edge 20 and the second-wallboard edge 22' and into the structural member 32. Alternatively, the first and second wallboards 10, 10' may be secured by fasteners to other structural members that are spaced from the joint 38 avoiding the need to pass a fastener through the first-wallboard edge 20 and the second-wallboard edge 22'.

At step 140, the user attaches to the second-wallboard face 14' the first end 26*a* of the facing-material 26 covering the first-wallboard face 14. Preferably, the attaching step 140 includes removing the removable strip 30 covering a portion of the first end 26*a* having an adhesive surface 28 and adhering the adhesive surface 28 to the second wallboard 10'. Preferably, but not necessarily, the joint 38 may be finished by application of joint compound. In applications where the user is indifferent about the appearance of the joint 38, the attaching step 140 may be omitted without departing from the spirit and scope of the invention.

Those skilled in the art will understand from the above disclosure that changes could be made to the embodiments described and without departing from the broad inventive concept thereof. It is understood, therefore, that this invention is not limited to the particular embodiments disclosed, but it is intended to cover modifications within the spirit and scope of the present invention.

I claim:

1. A wallboard comprising:

a core having a face and a back substantially parallel to the face;

a first edge extending between the face and the back, the first edge having a first-edge profile formed by first, second and third facets, the first facet adjacent the face and forming an acute angle with respect to the face, the second facet connecting the first and third facets and having a second-facet profile angled with respect to the face, the second-facet profile configured to have a shoulder generally equidistant from the first and third facets and to distribute over more than one-half a cross-section for the core a force applied to the first edge, the third face adjacent the back and forming an obtuse angle with respect to the back; and a second edge space from the first edge and extending between the face and the back, the second edge having a second-edge profile corresponding to an inverted mirror image of the first edge.

2. A wallboard comprising:

a core having a face and a back substantially parallel to the face;

a first edge extending between the face and the back, the first edge having a first-edge profile formed by first, second and third facets, the first facet adjacent the face and forming an acute angle with respect to the face, the second facet connecting the first and third facets and having a second-facet profile angled with respect to the face, the second-facet profile configured to distribute over more than one-half a cross-section of the core a force applied to the first edge, the third facet adjacent the back and forming an obtuse angle with respect to the back;

a second edge spaced from the first edge and extending between the face and the back, the second edge having a second-edge profile corresponding to the first-edge profile; and a facing-material covering the face, the facing-material having a first end and a second end, the first end extending beyond the face and having an adhesive surface, the second end spaced from the second edge.

3. The wallboard according to claim 2, wherein the facing-material has a thickness and the core underlying the first and second ends of the facing-material is recessed a depth generally corresponding to the thickness of the facing-material.

4. The wallboard according to claim 2, wherein the adhesive surface is covered by a removable strip.

5. A wallboard comprising:

a core having a face and a back substantially parallel to the face;

a first edge extending between the face and the back, the first edge having a first-edge profile formed by first, second and third facets, the first facet adjacent the face and forming an acute angle with respect to the face, the second facet connecting the first and third facets, the third facet adjacent the back and forming an obtuse angle with respect to the back;

a second edge spaced from the first edge and extending between the face and the back, the second edge having a second-edge profile corresponding to the first-edge profile; and a facing-material covering the face, the facing-material having a first end and a second end, the first end extending beyond the face and having an adhesive surface, the second end spaced from the second edge.

6. The wallboard according to claim 5, wherein the adhesive surface is covered by a removable strip.

7. A joint providing for the coupling of a first wallboard having a first-wallboard face with a second wallboard having a second-wallboard face and for the securing with a fastener the coupled first-wallboard and second wall-board to a structural member, the joint comprising:

a first edge of the first wallboard, the first edge having a first-edge profile formed by first, second and third facets, the first facet adjacent the first-wallboard face and forming an acute angle with respect to the first-wallboard face, the second facet connecting the first and third facets and having a second-facet profile angled with respect to the first and third facets, and the second edge is configured as an inverted mirror image of the first edge;

a second edge of the second wallboard adjacent the first edge, the second edge having a second-edge profile, the second edge configured to mate with the first edge, the first and second edge profiles configured to align the first-wallboard face with the second-wallboard face and maintain alignment; and a facing-material covering the face, the facing-material having a first end and a second end, the first end extending a length beyond the face and having an adhesive surface, the second end spaced the length of the first end from the second edge, wherein the first edge and the second edge are configured to allow the first and second wallboards to be secured to the structural member by the passing of the fastener through the first and second edges and into the structural member.

8. The joint according to claim 7, wherein the facing-material has a thickness, the first-wallboard face has a first wallboard recess adjacent the first edge, and the second-wallboard face has a second-wallboard recess adjacent the second edge, the first and second wallboard recesses having a depth generally corresponding to the thickness of the facing-material.

9. A method for joining adjacent wallboards and securing the wallboards to a structural member, the method comprising the steps of:

providing a first wallboard having a first-wallboard edge with a first-wallboard edge profile and a second wallboard having a second-wallboard edge with a second-wallboard edge profile corresponding to the first-wallboard edge profile;

mating the first-wallboard edge with the second-wallboard edge;

securing the first and second wallboards to the structural member by passing a fastener through the first-wallboard edge and the second-wallboard edge and into the structural member;

attaching to the second-wallboard a first end of a facing-material covering the first-wallboard face; and wherein the mating step comprises interlocking a first-wallboard edge shoulder extending from the first-wallboard edge with a corresponding second-wallboard edge shoulder extending from the second-wallboard edge.

10. The method of claim 9, wherein the attaching step comprises removing a removable strip covering a portion of the first end having an adhesive surface and adhering the adhesive surface to the second wallboard.

* * * * *